US010479594B2

(12) United States Patent
Kelly

(10) Patent No.: US 10,479,594 B2
(45) Date of Patent: Nov. 19, 2019

(54) SYSTEM AND METHODS FOR PACKAGING CABLES

(71) Applicant: Sean P. Kelly, Ridgewood, NJ (US)

(72) Inventor: Sean P. Kelly, Ridgewood, NJ (US)

( * ) Notice: Subject to any disclaimer, the term of this patent is extended or adjusted under 35 U.S.C. 154(b) by 288 days.

(21) Appl. No.: 15/467,493

(22) Filed: Mar. 23, 2017

(65) Prior Publication Data

US 2018/0002102 A1 Jan. 4, 2018

Related U.S. Application Data

(60) Provisional application No. 62/429,249, filed on Dec. 2, 2016, provisional application No. 62/350,363, filed on Jun. 15, 2016, provisional application No. 62/312,141, filed on Mar. 23, 2016.

(51) Int. Cl.

| | |
|---|---|
| ***B65D 85/04*** | (2006.01) |
| ***B65B 63/04*** | (2006.01) |
| ***B65D 43/14*** | (2006.01) |
| ***B65D 25/28*** | (2006.01) |
| ***B65D 25/10*** | (2006.01) |

(52) U.S. Cl.

CPC ..... *B65D 85/04* (2013.01); *B65B 63/04* (2013.01); *B65D 25/107* (2013.01); *B65D 25/2808* (2013.01); *B65D 43/14* (2013.01)

(58) Field of Classification Search

CPC ..... B65D 81/113; B65D 81/1075; B65D 81/107; B65D 43/14; B65D 25/107; B65D 85/04; B65B 55/20

USPC ..... 206/523, 524

See application file for complete search history.

(56) References Cited

U.S. PATENT DOCUMENTS

| | | | | |
|---|---|---|---|---|
| 3,850,296 | A * | 11/1974 | Hirata | B65D 25/107 118/500 |
| 4,836,379 | A * | 6/1989 | Shaw | B65D 81/107 206/453 |
| 7,967,146 | B2 * | 6/2011 | Chen | B65D 25/103 206/710 |
| 9,601,880 | B2 | 3/2017 | Rynaski et al. | |
| 2015/0280363 | A1 | 10/2015 | Rynaski et al. | |

* cited by examiner

*Primary Examiner* — King M Chu

(74) *Attorney, Agent, or Firm* — Onello & Mello, LLP.

(57) ABSTRACT

In a cable packaging system and method a retainer within a container retains coiled cables in a preferred orientation, such as a vertical orientation, with the coil axis of the coiled cable directed longitudinally toward sidewalls of the container and a diameter line of a plane defined by the coil directed toward the top and bottom of the container. The retainer may include a resilient material, such as a foam material, to allow insertion of a coiled cable and return at least partially to a neutral, pre-insertion, position to thereby engage and retain the coiled cable.

20 Claims, 16 Drawing Sheets

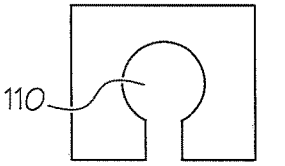
FIG. 3A
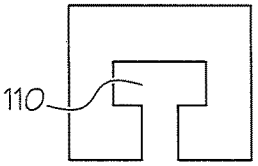
FIG. 3B
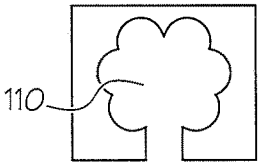
FIG. 3C
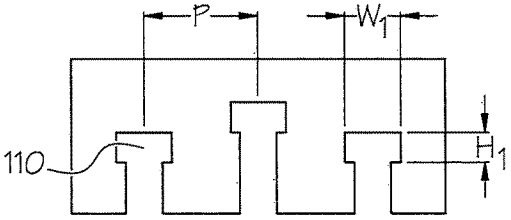
FIG. 3D
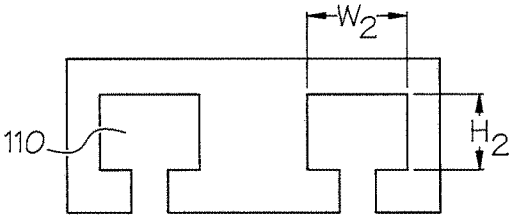
FIG. 3E
FIG. 3F
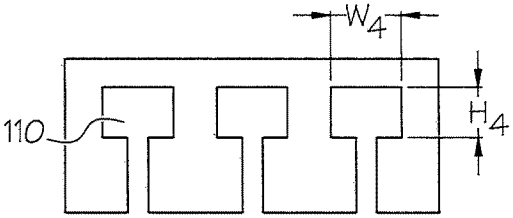
FIG. 3G
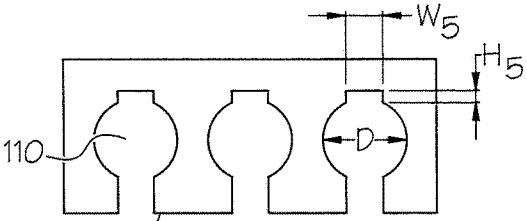
FIG. 3H

SYSTEM AND METHODS FOR PACKAGING CABLES

RELATED APPLICATIONS

This application is related to, and claims benefit of, U.S. Provisional Application No. 62/312,141, filed Mar. 23, 2016, U.S. Provisional Application No. 62/350,363, filed Jun. 15, 2016, and U.S. Provisional Application No. 62/429,249, filed Dec. 2, 2016, the contents of each of which is herein incorporated by reference in its entirety.

FIELD

Embodiments in accordance with principles of inventive concepts relate to methods and systems for packaging, particularly the packaging of wires, fibers, and cables, such as optical fiber or copper patch cords, for example.

BACKGROUND

Insulated cables with plugs, or connectors, at each end may be referred to as patch cords or patch cables. Patch cords, which may employ copper wire or optical fiber, for example, are used to enable communications between electronic devices such as network switches, servers, and storage devices in a data center or server farm, for example. Generally, customers order cables of different lengths in predetermined quantities based on their projected usage. That usage may vary according to a particular installation and the associated distances and numbers of connections between devices in the installation. A customer's requirements may frequently change to accommodate different installations or different aspects of a given installation (through reconfiguration, for example). To satisfy customers' varying cable requirements, cable providers produce cable assemblies of varying length and quantity from reels of cable material. In addition to the wasted cable material associated with such an approach, cables are typically provided to a customer loose within a box and, possibly, wrapped in a plastic sleeve.

A customer, such as a technician installing or reconfiguring an electronic installation, such as a data center, may have to fumble through a loose-packed container of cables and unwrap the cables before use. Oftentimes, the connectors on the cable-ends may engage with one another, causing further delays and annoyances. Although this may seem to be no more than a minor annoyance, when repeated tens, or even hundreds, of times per day, five days a week, fifty weeks out of the year, this approach to packaging cables, cords, straps, and wires may contribute to a significant inefficiency and associated expense.

SUMMARY

In example embodiments a cable packaging system in accordance with principles of inventive concepts includes a retaining device, or retainer, positioned within a container, such as a box. The retainer holds one or more cables within the box, and may hold them in a predetermined orientation for ready access by a user. The retainer may keep cables separated and well organized within the box. In example embodiments cables are coiled before placement within the container and the retainer holds the coiled cables in an upright, or vertical, position, with a portion of the coiled cable exposed for easy access by a user. Other orientations, such as horizontal to, or at an angle slanted to, the plane defined by the container bottom, are contemplated within the scope of inventive concepts, however. Similarly, although example embodiments herein illustrate cables that are retained at a ninety degree angle with sidewalls of a container (and parallel with other sidewalls), cables may be held in a predetermined position that is at an angle other than ninety degrees to sidewalls. Although the containers in illustrative embodiments are rectangular (including cuboid), other shapes, including all manner of parallelogram, trapezoid, triangle, ellipse, oval, or circle are all contemplated within the scope of inventive concepts. Although the containers of illustrative embodiments are composed of a cardboard material, any other material suitable for packaging, shipping, or otherwise handling is contemplated within the scope of inventive concepts.

In example embodiments a retainer may include a retention opening configured to grasp a coiled cable and to hold the cable upright within a container. The retainer may be positioned on a side of the interior of a container, with the retention opening configured to hold the topmost part of the cable at a level at or below the top of the container, to allow a container lid to be closed and to position the cable for easy grasping by a user. In example embodiments the retainer may be of a resilient material that yields to the insertion of the cable, but springs back toward a neutral position to hold the cable in place after the cable has been inserted. To that end, the retainer may be implemented with a resilient foam material, for example, such as a biodegradable foam, a polystyrene foam, a polyethylene foam, a polyurethane foam, a cross-linked polyurethane foam, expanded polyethylene, extruded polyethylene, molded polyethylene, polyester foam, polyurethane foam, or polypropylene foam, for example. Other materials, such as cardboard, are contemplated as retainer materials within the scope of inventive concepts. Retainers may be implemented as inserts, with retention elements, such as retention strips, combined with retentions supports that support the retention elements. In a single-row example embodiment, a single insert, including a retention support element that includes two lines of vertical elements that are inserted in respective slots of two foam retention strips to support the retentions strips places retention elements on opposing sidewalls of a container to hold a plurality of coiled cables in place. Additional retainers may be included to hold a plurality of rows of coiled cables in predetermined orientation(s) within a container. Additional retainers, or retention elements may be placed in other locations, such as, on the bottom of the container, for example, to provide additional support for cables. However, inventive concepts are not limited thereto, and retainers may be insert-free, with retention elements, or retainers, directly affixed to container walls and/or tops or bottoms, for example.

In example embodiments in accordance with principles of inventive concepts, a retainer may be implemented as a strip of foam material having a plurality of retention openings to accept a corresponding plurality of coiled cables. A plurality of such retention strips may be employed within a container to provide aligned retention of a plurality of coiled cables. A cable packaging system in accordance with principles of inventive concepts may include retention element supports configured to support such strips within a container. Retention element supports in accordance with principles of inventive concepts may be configured to hold retention strips at a predetermined height at which retention openings within the retention strips retain coiled cables at a preferred height within a container so that, for example, the topmost point of the coiled cables are below the level of the top of the container's sides, thereby allowing for proper closing of the container. A single retention element support may provide support for a plurality of retention strips, for example, with a plurality of rows of vertical members configured for insertion in the retention strips. Each vertical member may include cutouts, tabs, or other features to act as stops that hold the retention strips in position. In example embodiments in accordance with principles of inventive concepts, a plurality of retention element supports, or, at least, rows of supports, may be used to retain more than one row of coiled cables. Retainers may be positioned so that retention openings in the retainers are located at a distance from one another that is substantially coincident with the coil diameter of a coiled cable.

In example embodiments the retainer may be a block with slits or slots formed therein to receive coiled cables and to hold them in a preferred orientation within a box. The block may be of a foam material, such as a biodegradable foam, a polystyrene foam, a polyethylene foam, a polyurethane foam, or a cross-linked polyurethane foam, for example. The retainer may be sized to fit snugly within a box and may thereby be held in place within the box through a friction fit, for example. Other materials, such as cardboard, are contemplated within the scope of inventive concepts.

In example embodiments in accordance with principles of inventive concepts, a packaging system includes a container to hold coiled cables and a retainer to hold the coiled cables within the container, the retainer holding the coiled cables in a predetermined orientation within the container.

In example embodiments in accordance with principles of inventive concepts, a packaging system includes a retainer wherein the retainer comprises a retention strip including retention openings configured for receiving coiled cables.

In example embodiments in accordance with principles of inventive concepts, a packaging system includes a retainer wherein the retainer includes a resilient material and the retention openings are configured to deform to receive a coiled cable and return toward a neutral position once the coiled cable is received.

In example embodiments in accordance with principles of inventive concepts, a packaging system includes a retainer wherein the retainer is a resilient foam material.

In example embodiments in accordance with principles of inventive concepts, a packaging system includes a retention element support configured to hold the retainer in a predetermined position.

In example embodiments in accordance with principles of inventive concepts, a packaging system includes a retention element support wherein the retention element support includes a plurality of vertical portions configured to matingly join a resilient foam retention strip through openings in the foam.

In example embodiments in accordance with principles of inventive concepts, a packaging system includes retention openings wherein the openings are of a circular cross-section.

In example embodiments in accordance with principles of inventive concepts, a packaging system includes retention openings wherein the openings are of a rectangular cross-section.

In example embodiments in accordance with principles of inventive concepts, a packaging system includes retention openings wherein the openings are staggered in distance from a lateral edge of the retention strip.

In example embodiments in accordance with principles of inventive concepts, a packaging system includes two retention strips wherein two retentions strips are arranged with staggered openings to form alternate-positioned cable receptacles.

In example embodiments in accordance with principles of inventive concepts, a packaging system includes a retainer wherein the retainer is configured to hold the coiled cables in a vertical direction.

In example embodiments in accordance with principles of inventive concepts, a packaging system includes a container including four sidewalls a bottom and lid and a retainer, wherein the retainer includes a plurality of retention strips each having retention openings, a plurality of retention element supports, supporting the retention strips at a predetermined height within the container, wherein the retention strips are composed of a resilient material and two retention strips are in contact with opposing sidewalls of the container.

In example embodiments in accordance with principles of inventive concepts, a packaging system includes retention strips wherein the retentions strips are composed of a resilient foam material.

In example embodiments in accordance with principles of inventive concepts, a packaging system includes at least one additional retention strip positioned between the two retentions strips in contact with opposing sidewalls of the container.

In example embodiments in accordance with principles of inventive concepts, a packaging system includes retention strips wherein the retention strips are paired to support coiled cables and the distance between retention strips is predetermined to accommodate the diameter of the coil.

In example embodiments in accordance with principles of inventive concepts, a method of packaging cables includes providing a container including four sidewalls a bottom and lid providing a retainer, wherein the retainer includes a plurality of retention strips each having retention openings, a plurality of retention element supports, supporting the retention strips at a predetermined height within the container, wherein the retention strips are composed of a resilient material and two retention strips are in contact with opposing sidewalls of the container, and providing coiled cables, the coiled cables inserted in pairs of retention openings in the retentions strips, thereby retaining the coiled cables in an upright position.

In example embodiments in accordance with principles of inventive concepts, a method of packaging cables includes providing retentions strips that are composed of a resilient foam material.

In example embodiments in accordance with principles of inventive concepts, a method of packaging cables includes providing at least one additional retention strip positioned between the two retentions strips in contact with opposing sidewalls of the container.

In example embodiments in accordance with principles of inventive concepts, a method of packaging cables includes providing retention strips that are paired to support coiled cables and the distance between retention strips is predetermined to accommodate the diameter of the coil.

In example embodiments in accordance with principles of inventive concepts, a method of packaging cables includes providing retention openings that are staggered to retain the coiled cables in a staggered arrangement.

BRIEF DESCRIPTION OF THE DRAWINGS

The foregoing and other objects, features and advantages of exemplary embodiments in accordance with principles of inventive concepts will be apparent from the more particular description of exemplary embodiments, as illustrated in the accompanying drawings in which like reference characters refer to the same elements throughout the different views. The drawings are not necessarily to scale, emphasis instead being placed upon illustrating the principles of the inventive concepts in the drawings.

FIG. 3A through FIG. 3H are top plan views of retention openings for an example embodiment of a cable packaging system in accordance with principles of inventive concepts;

DETAILED DESCRIPTION

Figure 1:
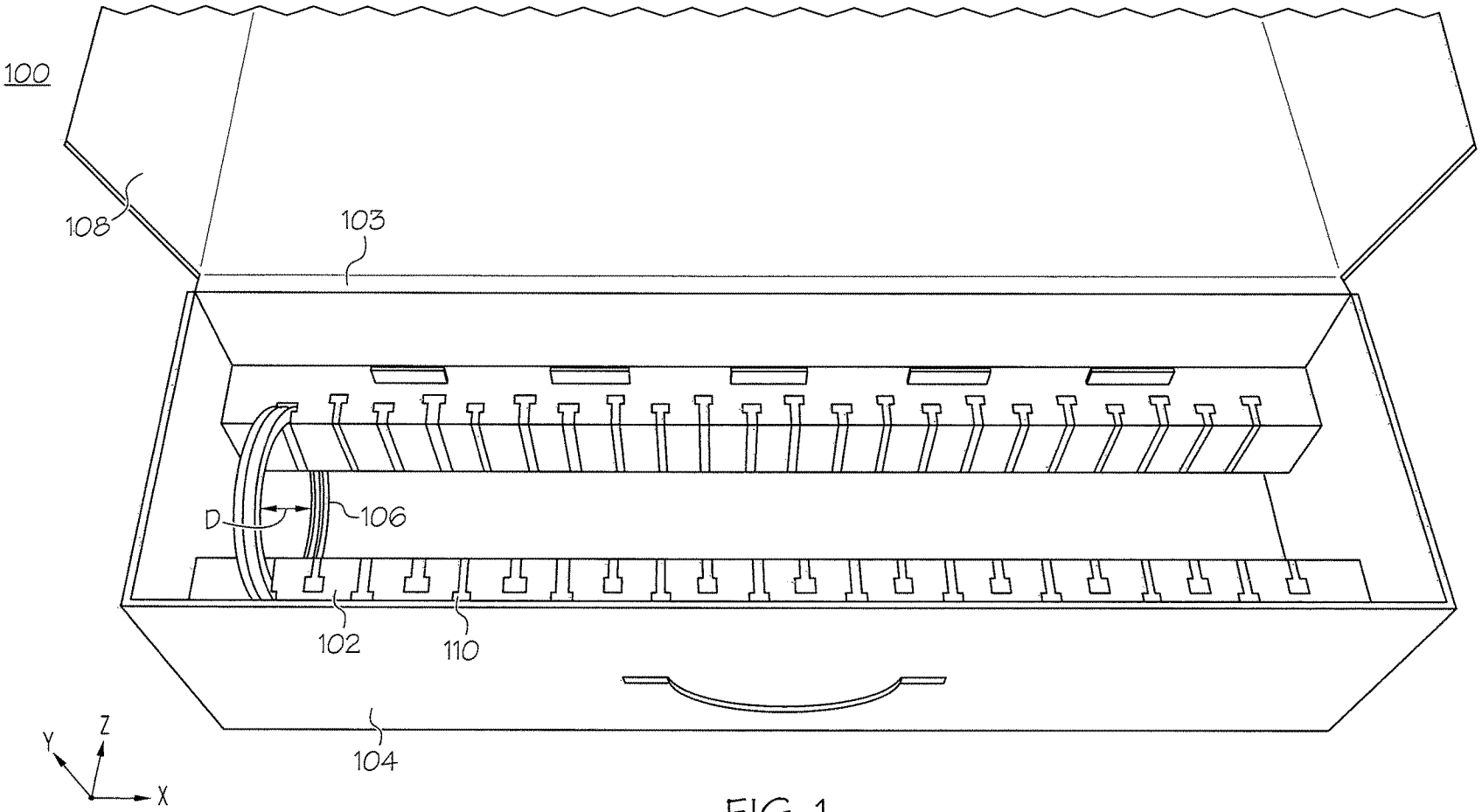
FIG. 1 is a top plan view of an example embodiment of a cable packaging system in accordance with principles of inventive concepts.

The foregoing and other objects, features and advantages of the exemplary embodiments of inventive concepts will be apparent from the more particular description of exemplary embodiments of inventive concepts, as illustrated in the accompanying drawings in which like reference characters refer to the same parts throughout the different views. The drawings are not necessarily to scale, emphasis instead being placed upon illustrating the principles of inventive concept in the drawings.

The terminology used herein is for the purpose of describing particular exemplary embodiments in accordance with principles of inventive concepts and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on" or "connected" or "coupled" to another element, it can be directly on or above, or connected or coupled to, the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.). When an element is referred to herein as being "over" another element, it can be over or under the other element, and either directly coupled to the other element, or intervening elements may be present, or the elements may be spaced apart by a void or gap.

In the example embodiment of FIG. 1 a cable packaging system 100 in accordance with principles of inventive concepts includes a retaining device, or retainer 102, positioned within a container 104, such as a box. In example embodiments the container 104 may be sized to hold cables within snuggly, with only limited room for movement, thereby working in concert with retainer 102 to maintain cables 106 in a preferred orientation. In example embodiments, the container provides less than one inch between the top of a coiled cable contained therein and the lid of the container; in other embodiments, the container provides less than one half inch of such margin and in other embodiments the container provides less than one quarter of an inch of such margin. The retainer 102 holds one or more cables 106 within the box, and may hold them in a preferred orientation for ready access by a user. The retainer 102 may keep cables separated and well organized within the box. In example embodiments cables are coiled before placement within the container 104 and the retainer 102 holds the coiled cables 106 in an upright, or vertical, position, with a portion of the coiled cable 106 exposed for easy access by a user. In the example embodiment of FIG. 1, the upright position is exemplified by the axis of the opening in the coiled cable 106 along a first axis in the +X, −X direction. The direction from the bottom to the top of the coiled cable 106 is in along a second axis in the +Y, −Y direction, and the sides of the container 104 along which retainers 102 are located opposing one another lie separated in a third direction along a third axis in the +Z, −Z direction. The separation distance between cables may be determined by the dimension of the coiled cable in the Z direction. That is, in example embodiments, coiled cables may be separated at the their respective retention openings by a distance that allows the coiled cables to contact one another, without crowding or overlap, to provide ready access to a customer/installer.

In example embodiments in accordance with principles of inventive concepts, an installer need not fumble through a loose-packed container of patch cables and unwrap the patch cables before use. Nor will the installer have to deal with connectors on the cable-ends that have engaged with one another, thereby avoiding further delays and annoyances. These savings, when repeated hundreds of times per day, five days a week, fifty weeks out of the year for each installer, may contribute to significant efficiencies, reduced frustration and improved overall performance.

In example embodiments a retainer 102 may include a retention opening 110 configured to grasp a coiled cable 106 and to hold the cable upright (or in another predetermined orientation) within a container 104. The retainer 102 may be positioned on a side of the interior of a container 104, with the retention opening 110 configured to hold the topmost part of the cable at a level at or below the top of the container, to allow a container lid 108 to be closed and to position the cable for easy grasping by a user. In example embodiments the retainer 102 may be of a resilient material that yields to the insertion of the cable and springs back toward a neutral position to hold the cable in place after the cable has been inserted. To that end, the retainer 102 may be implemented with a resilient foam material such as a biodegradable foam, a polystyrene foam, a polyethylene foam, a polyurethane foam, or a cross-linked polyurethane foam, for example. However, inventive concepts are not limited thereto and other materials, such as cardboard, are contemplated within the scope of inventive concepts. Retainers 102 may be placed on opposing sidewalls 103 of a container 104 to hold a plurality of coiled cables 106 in place. Additional retainers may be placed in other locations, such as, on the bottom of the container 104, for example, to provide for additional support.

Figure 2:
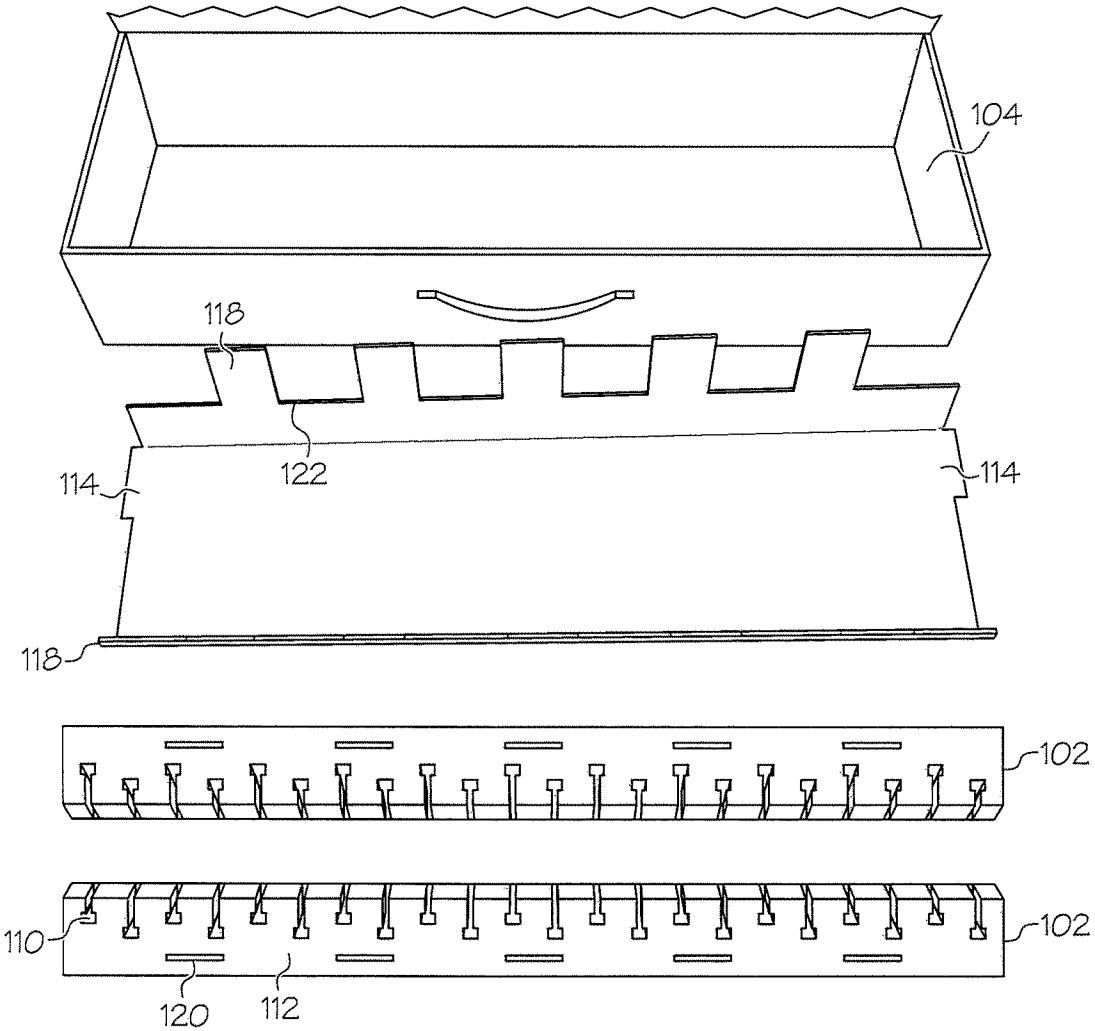
FIG. 2 is an exploded view of an example embodiment of a cable packaging system in accordance with principles of inventive concepts.

In the example embodiment in accordance with principles of inventive concepts of the exploded view of FIG. 2, a retainer 102 may be implemented using a strip of foam material having a plurality of retention openings 110 to accept a corresponding plurality of coiled cables 106. A plurality of such retention strips 112 may be employed within a container 104 to provide aligned retention of a plurality of coiled cables 106. A cable packaging system in accordance with principles of inventive concepts may include retention element supports 114 configured to support retention strips 112 within a container 104. Retention element supports 114 in accordance with principles of inventive concepts may be configured to hold retention strips at a predetermined height at which retention openings 110 within the retention strips 112 retain coiled cables 106 at a predetermined height within a container 104 so that, for example, the topmost point of the coiled cables 106 are below the level of the top of the container 104's sides, thereby allowing for proper closing of the container 104.

A single retention element support 114 may provide support for a plurality of retention strips 112, for example, with a plurality of rows of vertical members 118 configured for insertion in the retention strips 112 through slits 120. Each vertical member 118 may include cutouts, tabs, or other features to act as stops 122 that hold the retention strips 112 in position. In some example embodiments, the retention strips 112 are held in position by the stops 122 so that a lower portion of the retention strips 112 are suspended above a floor of the container 108. In example embodiments in accordance with principles of inventive concepts, a plurality of retention element supports 114, or, at least, rows of supports 114, may be used to retain more than one row of coiled cables 106. Retainers may be positioned so that retention openings 110 in the retainers are located at a distance from one another, separated along in the third direction that is substantially coincident with the coil diameter of a coiled cable 106. See diameter D of coiled cable 106 of FIG. 1 Other orientations, such as parallel with the plane of the bottom of the container, or at an acute or obtuse angle with the plane of the bottom of the container are contemplated within the scope of inventive concepts. Additionally, although retainers 102 are illustrated as orienting coiled cables 106 at a ninety degree angle with the sidewalls of container 104, retainers 102 may orient the coiled cables at any angle with the sidewalls of container 104, from zero to ninety to one hundred and eighty, for example.

In the example embodiment of FIG. 1 and FIG. 2, for example, retention strips 112 are located opposing one another along the sidewalls 103 extending along the X direction of container 104. In the example embodiment of FIG. 1 (see also, the detailed view of FIG. 6), retention openings 110 are positioned a two different distances from the lateral edges of retention strips 112, with every other opening closer to the inner edge of the retention strip. With the opposing retentions strip having the same arrangement, but starting with an opposite positioning (that is, a first opening of a first strip closer to the inner edge than a second opening and a first opening of the opposing strip farther from the inner edge than a second opening), the combined retention strips are configured to stagger coiled cables 106 along their lengths within the container 104, as illustrated with the alternate-positioned retention openings 110 of FIG. 1. In example embodiments in accordance with principles of inventive concepts, such an arrangement of retention openings may be employed to add strength of stiffness to retention strip 112.

As will be described below, additional retention element supports 114 may be included to support additional retention strips 112, thereby accommodating additional rows of coiled cables 106. Retention element supports 114 may also be implemented with an adhesive material, with the retention strips 112 adhered to vertical members 118 and/or to sidewalls of container 104, for example. In example embodiments retention strips 112, formed of a resilient material, such as a resilient foam, may be of a thickness T suited to ensure sufficient support for coiled cables 106. In example embodiments, the thickness T may range from less than one inch to several inches, depending upon the size of the coiled cables 106 and the rigidity of the retention strip material. In example embodiments, thickness T may be selected from a range of standard thicknesses available from manufacturers of foam sheets, for example, and the shape and size of retention openings 110 may be selected from available dies used to form retention openings 110 in retention strips 112.

In example embodiments in accordance with principles of inventive concepts retention openings 110 may take on a variety of shapes, as illustrated by the round retention opening 110 of FIG. 3A, the rectangular retention opening 110 of FIG. 3B, and the round-scalloped retention opening 110 of FIG. 3C. Each shape may be particularly suited to the shape of coiled cable 106 to be contained, with, for example, a flat cable more suitably retained by a rectangular retention opening of FIG. 3B and a round cable more suitably retained by a round opening of FIG. 3A or the round-scalloped opening of FIG. 3C. In accordance with principles of inventive concepts, the size of retention openings 110 may vary according to the diameter of coiled cable 106 to be packaged and according to the number of coils in the cable.

Because the number of coils in the cable 106 may be related to the length of the cable, we can say that the size of the retention openings 110 may be a function of the diameter and length (as manifested in the number of coils, or loops) of the cable. For example, the retention openings 110 of FIG. 3D through FIG. 3F may be employed for Ethernet cables (which may include a copper conductor in embodiments in accordance with principles of inventive concepts) in lengths of 3', 5', 7' and 10', with opening heights of H1 ⅜" and widths W1 7/16" (FIG. 3D), with 66 cables of three rows in a 25" long L×30" wide W×7" high H box (illustrated in the example embodiment of FIG. 7); Ethernet cables in lengths of 15' or 25' with heights H3 ⅞"and Widths W3 1" (FIG. 3E) in a box of the same size, and Ethernet cables in lengths of 30', 35', 40', 45', or 50' with heights H2 greater than ⅞' and widths W2 greater than 1" of (FIG. 3F) in a box of the same size.

Similarly, 28 fiber cables of 0-8 meters may be accommodated in a box of the same size using openings illustrated in FIG. 3G with openings having heights of H4 ½" and widths W4 of ⅝", or 45 8-20 meter fiber cables may be accommodated in a box of the same size using openings illustrated in FIG. 3H with openings of a diameter D of 1" and heights H5 of ⅜" and widths of ½". In example embodiments in accordance with principles of inventive concepts, for example as described herein in connection with the embodiment of FIG. 11, different cables of different sizes may be arranged in different rows of the same container, with, for example, retentions strips having the openings of FIG. 3G in one row to accommodate 28 fiber cables of 0-8 meters and openings of FIG. 3H to accommodate 15 8-20 meter fiber cables in another row (or rows). In example embodiments, each type of cable may be identified through markings, such color or other labeling, to identify type and/or length, for example. Although the standard openings just described may accommodate the vast majority of cable lengths and thicknesses, in order to accommodate larger cables, a tab, such as tab TB of FIG. 3H, may be eliminated, for example, while packing cables.

Figure 4:
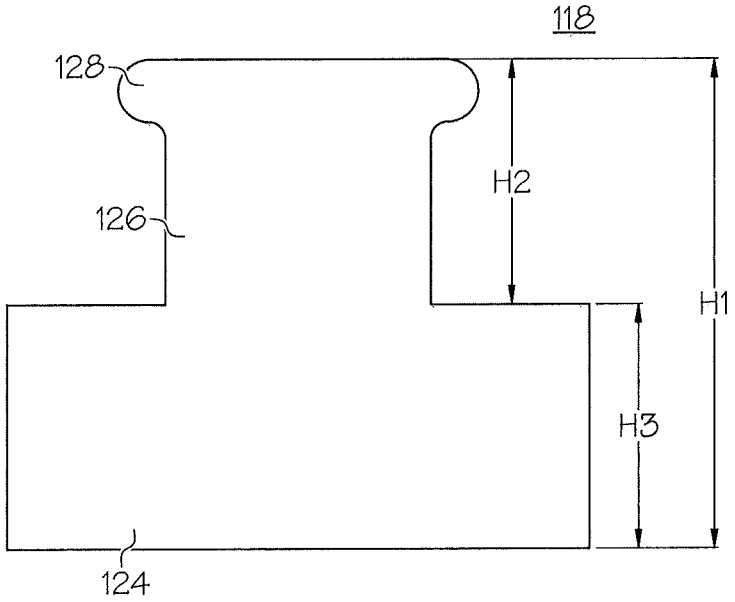
FIG. 4 is a side view of a retention support for an example embodiment of a cable packaging system in accordance with principles of inventive concepts.

A vertical member 118 such as that illustrated in FIG. 2 is shown in greater detail in FIG. 4. In this example embodiment vertical member 118 may be implemented in cardboard, for example. Vertical member 118 may include a horizontal portion 124, vertical portion 126, and horizontal tabs 128 projecting from either side of vertical portion 126. The height H1 from the bottom of vertical member 118 to the top may be predetermined to hold the top of retention strip 112 at a height suitable for retaining coiled cables in a vertical position with their tops at a level lower than the closed lid 108 and the bottoms of the coiled cables just above, or in contact with, the bottom of container 104. Because the vertical potion 126 and tabs 128 are inserted in retention strip 112, the horizontal portion 124 may have a height H3 that supports the retention strip 112 at a predetermined height and the height H3 of vertical portion 126 may match the thickness of retention strip 112. In a case where the container is configured to include multiple rows of coiled cables, as described herein, the vertical members 118 of neighboring element supports can be aligned face-to-face and positioned in the same slot 120 of the same retention strips 102. In this manner, the system can be expandable to accommodate increasing numbers of rows of coiled cables.

Figure 5:
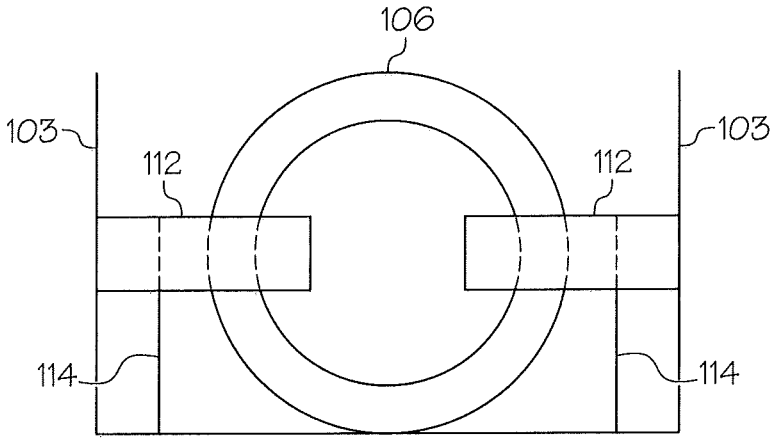
FIG. 5 is a sectional view of a container with retention strips, retention supports and coiled cable in an example embodiment of a cable packaging system in accordance with principles of inventive concepts.

The sectional view of FIG. 5 illustrates a view along the first, X, direction into container 104. A coiled cable 106 is supported by retention strips 112, which are, in turn, supported by retention element supports 114. In example embodiments vertical members 118, a part of retention element support 114, may be inserted in slits 120 within retention strips 112 to secure the retention strips 112 at a predetermined height. Additionally, as previously described, retention openings 110 may be formed in retention strips 112 and held apart at a predetermined distance by retention element supports 114 in a manner that situates the retention openings 110 at locations to engage with the coiled cable 106. In example embodiments in accordance with principles of inventive concepts, retention openings 110 may be staggered within opposing retention strips, as in FIG. 1 and FIG. 3D, for example, to, as previously described, provide more support for the coiled cables 106, as well as to allow neighboring coiled cables 106 to be positioned more closely together.

Figure 6A:
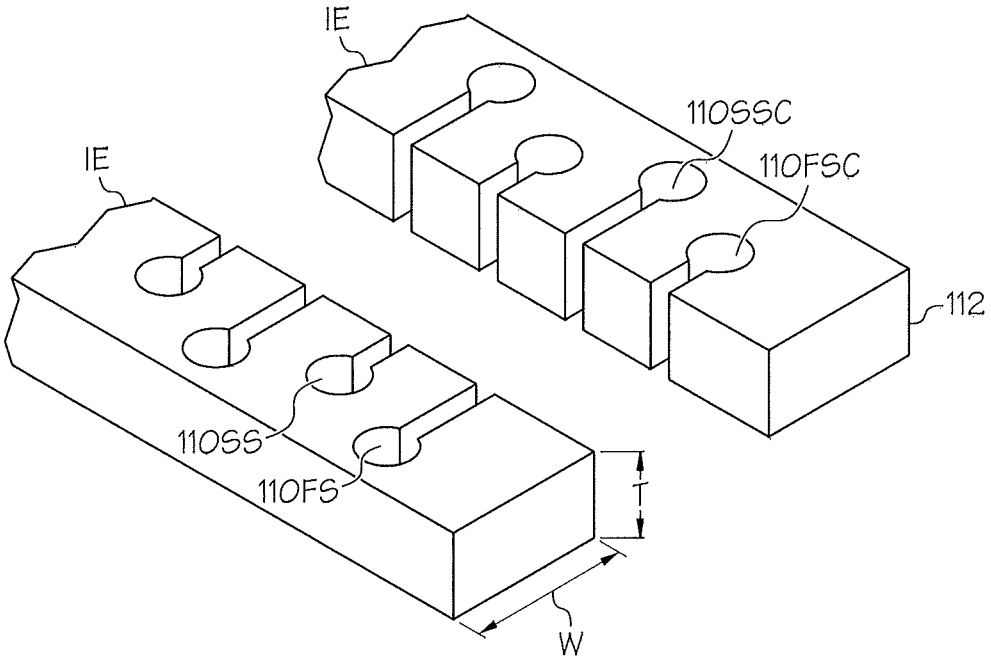
FIG. 6A and FIG. 6B are more detailed views of retention strips in an example embodiment of a cable packaging system in accordance with principles of inventive concepts.

In the example embodiment of FIG. 6A retention openings 110 are positioned at two different distances from the lateral edges of retention strips 112, with every other opening closer to the inner edge IE of the retention strip. With the opposing retentions strip having the same arrangement, but starting with an opposite positioning (that is, a first opening 110*fs* of a first strip farther from the inner edge than a second opening 110*ss* and a first opening 110*fsc* of the opposing strip closer the inner edge than a second opening 110*ssc*), the combined retention strips are configured to stagger coiled cables 106 along their lengths within the container 104, as illustrated with the alternate-positioned retention openings 110 of FIG. 1. As will be described below, additional retention element supports 114 may be included to support additional retention strips 112, thereby accommodating additional rows of coiled cables 106. In example embodiments retention strips 112, formed of a resilient material, such as a resilient foam, may be of a thickness T and width W suited to ensure sufficient support for coiled cables 106. In example embodiments, the thickness T and width W may range from less than one inch to several inches, depending upon the size of the coiled cables 106 and the rigidity of the retention strip material.

Figure 6B:
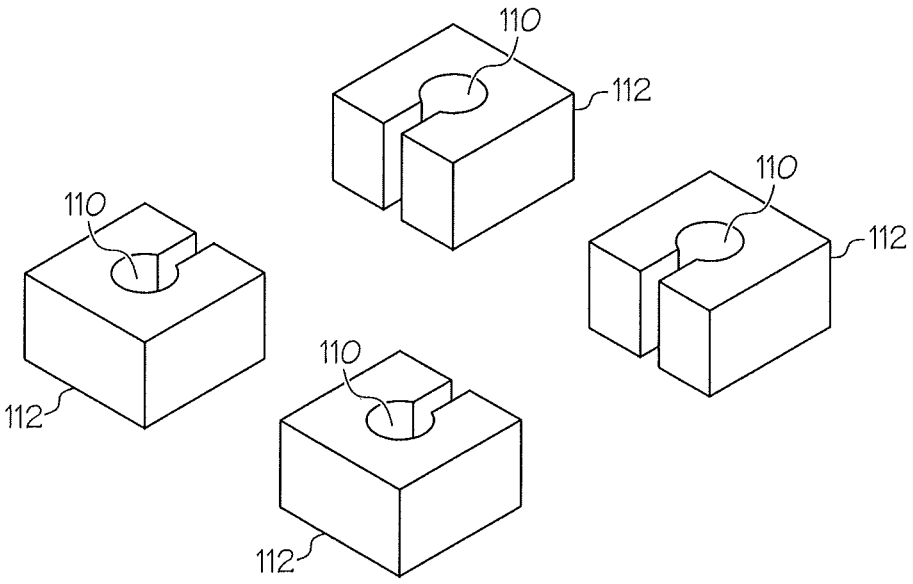

As illustrated in the example embodiment of FIG. 6B retention strips 112 may include any number of retention openings 110, such as the single-opening 110 embodiment illustrated.

Figure 7:
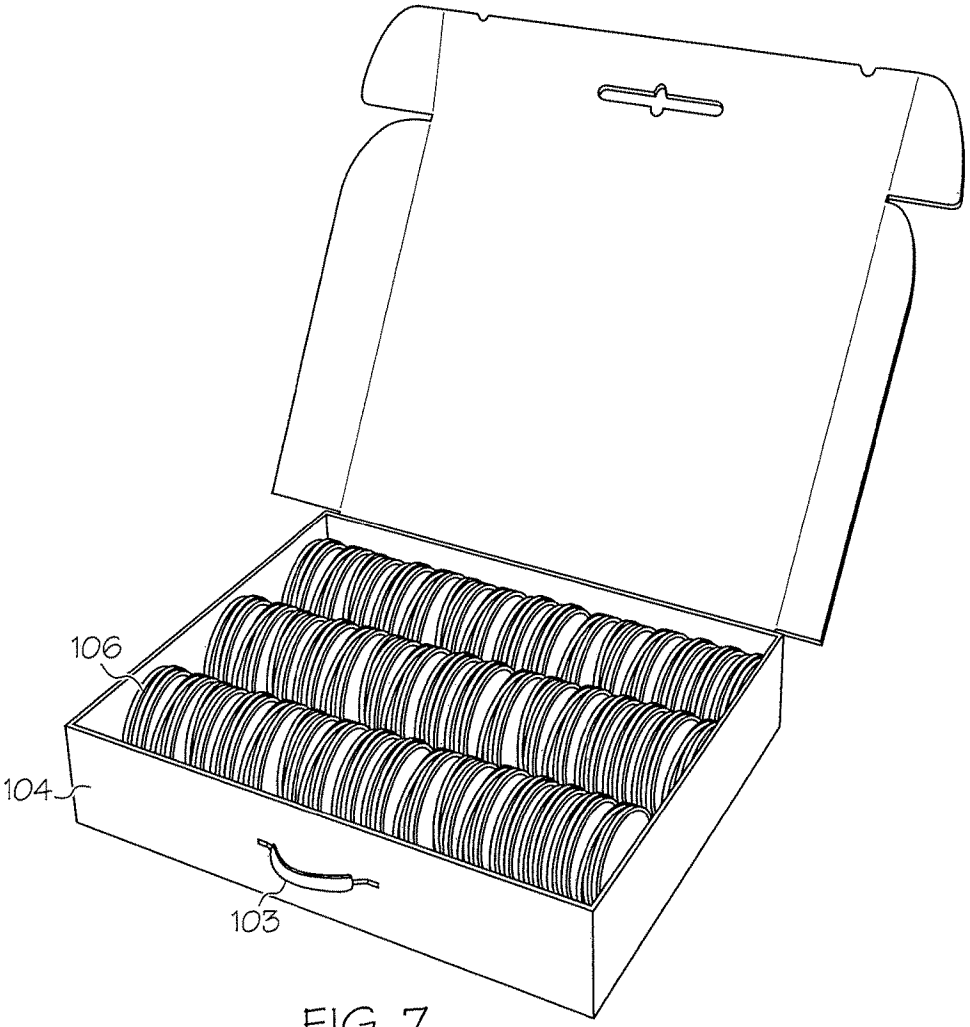
FIG. 7 is a perspective view of a multi-row example embodiment of a cable packaging system in accordance with principles of inventive concepts holding multiple rows of coiled cables.

FIG. 7 is an example embodiment of a multi-row coiled-cable container in accordance with principles of inventive concepts. In this example embodiment, four rows of retention element supports 114 hold four retention strips 112 in place to hold coiled cables 106 in vertical positions within container 104. In this example embodiment, a handle 103 provides for convenient carrying of container 104.

Figure 8A:
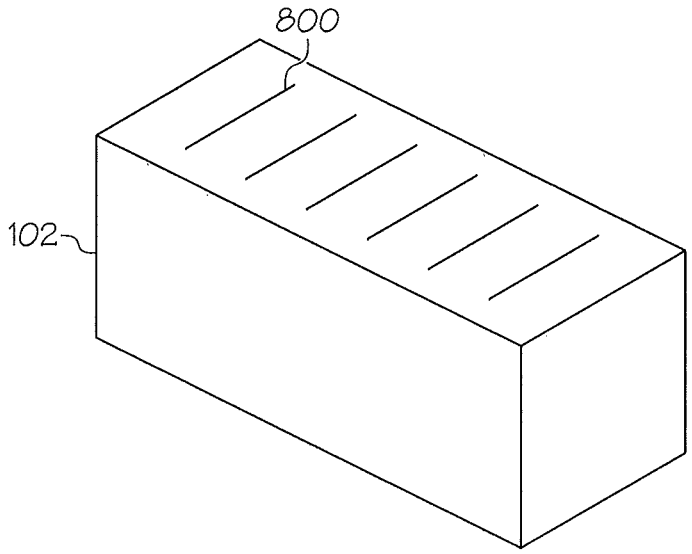
FIG. 8A through 8C are views of alternative embodiments of coiled cable retainers in accordance with principles of inventive concepts.
Figure 8B:
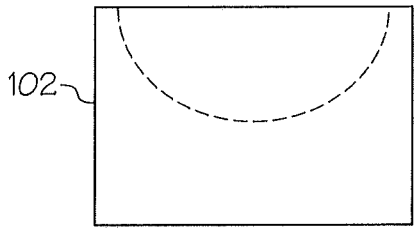
Figure 8C:
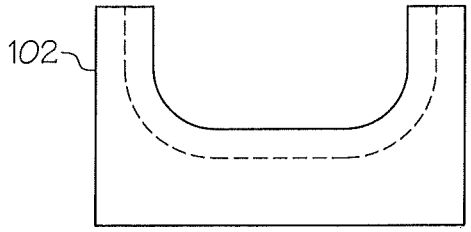

In other example embodiments the retainer 102 may be a block with slots 800, or trenches formed therein to receive coiled cables 106 and to hold them in a preferred orientation (e.g., vertical) within a box, as illustrated in the perspective view of FIG. 8A. The block may be of a foam material, such as a biodegradable foam, a polystyrene foam, a polyethylene foam, a polyurethane foam, or a cross-linked polyurethane foam, for example, or, simply, cardboard. The retainer 102 may be sized to fit snugly within a box and may thereby be held in place within the box through a friction fit, for example. Other materials, such as cardboard, are contemplated within the scope of inventive concepts. FIG. 8B is an end-view of the block 102, with slots shown in broken line and FIG. 8C is an end-view of the block 102, with a concave upper portion and slot bottom shown in a broken line.

Figure 9A:
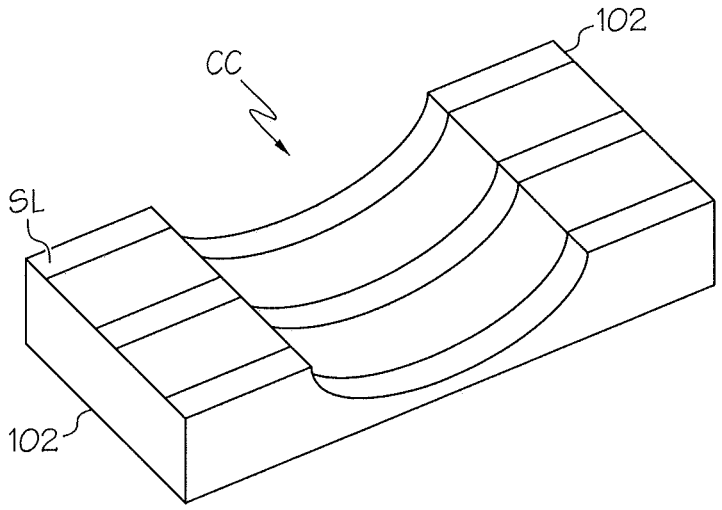
FIG. 9A and FIG. 9B are views of additional alternative embodiments of coiled cable retainers in accordance with principles of inventive concepts.
Figure 9B:
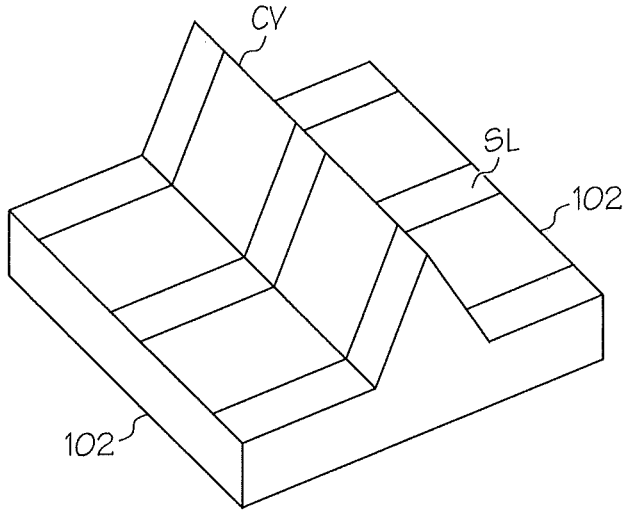

In the example embodiments of FIG. 9A and FIG. 9B retainers 102 may include slotted concave CC or convex CV elements, respectively, to engage with and retain coiled cables. Such retainers 102 may employ any materials previously mentioned, including various resilient materials, such as a foam material, or less-resilient material, such as cardboard.

Figure 10A:
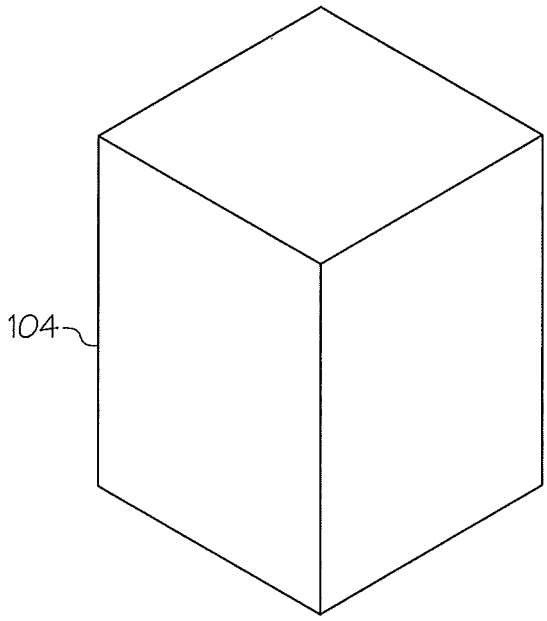
FIG. 10A and FIG. 10B are views of additional alternative embodiments of coiled cable retainers in accordance with principles of inventive concepts and retention elements, such as retention inserts that may be stacked, respectively.
Figure 10B:
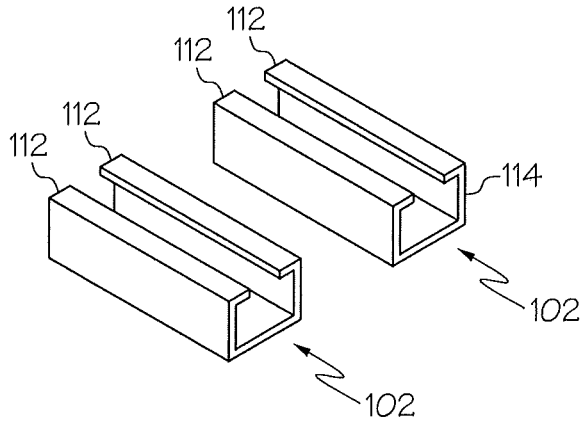

Shipping prices associated with packaging sizes may favor one aspect ratio of a container over another and, as a result, a container 104 in accordance with principles of inventive concepts may be implemented in a cubic form, as illustrated in the example embodiment of FIG. 10A. In such an embodiment retainers 102 may be implemented, as previously described and as shown in FIG. 10B, as inserts having retentions strips 112 and retention supports 114, layered side-by-side and stacked to substantially fill a cubic container, for example. Similar arrangements may be employed to combine other retainers described herein in a cubic container.

Other retainer arrangements are contemplated within the scope of inventive concepts, such as tubes around which coiled cables may be suspended or stacked, or inserted into slots on the tubes, with the slots varying in size to accommodate different cables.

In example embodiments container 104 may be implemented with a plastic material or other material that does not react with copper in patch cables, such as a plastic that may be safely used in a clean room facility, for example, and/or a material that is non-static. To prevent against the intrusion of contaminants, the container may be sealed and made airtight and employ non-carbon material, including plastic metal wood, non-carbon cardboard (virgin wood), and non-static foam. Although container 104 may be of any size, sized may be chosen to suit shipping preferences, with container sizes chosen to evenly fit (that is, fit with an integer number of containers) on a standard pallet, for example, and to evenly stack to a standard height.

Figure 11:
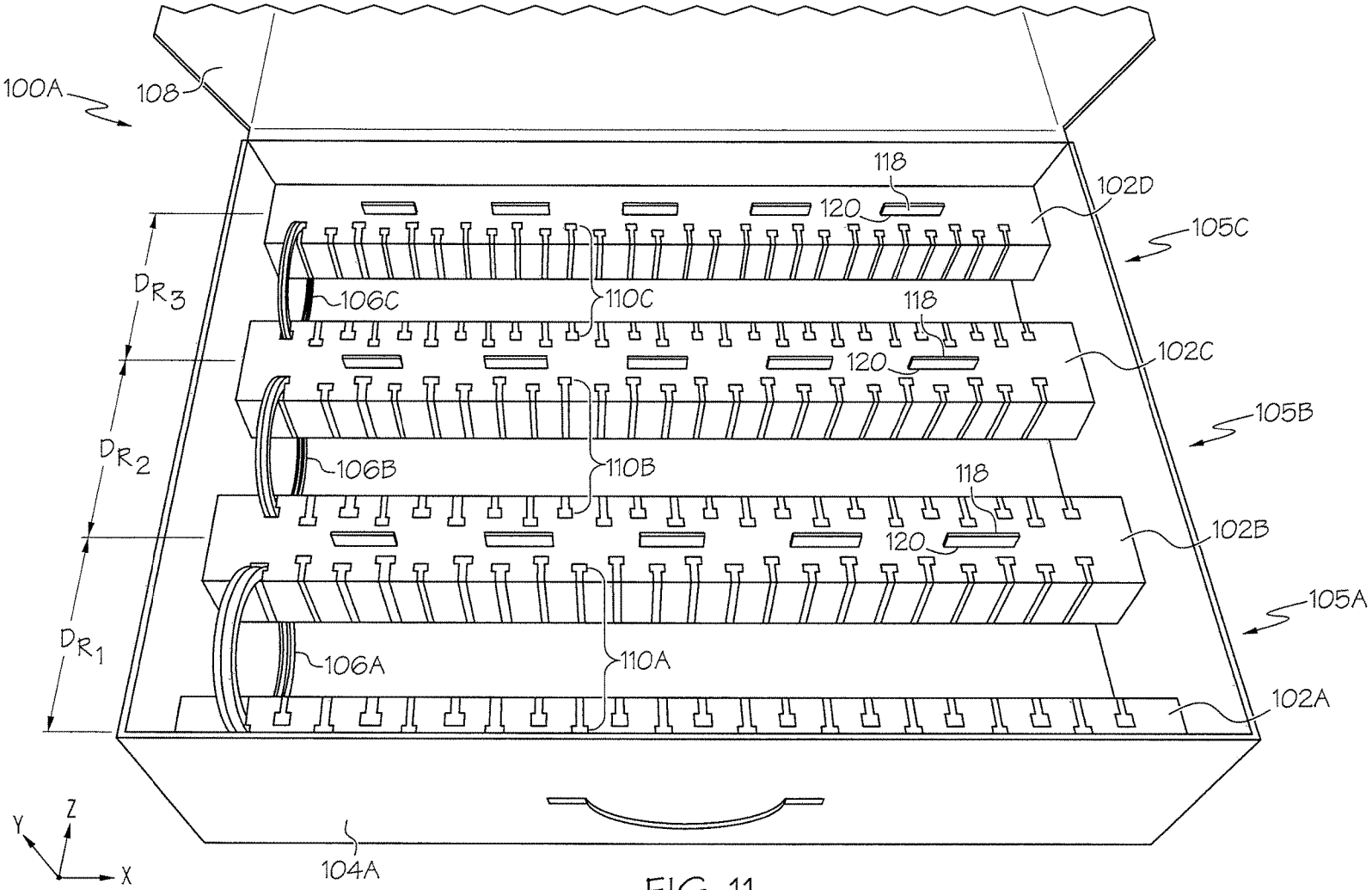
FIG. 11 is a top plan view of an alternative embodiment of a cable packaging system in accordance with principles of inventive concepts, wherein the system is configured to accommodate different-sized coiled cables in different rows of the container.

FIG. 11 is a top plan view of an alternative embodiment of a cable packaging system in accordance with principles of inventive concepts, wherein the system is configured to accommodate different-sized coiled cables in different rows of the container. In the view of FIG. 11, the cable packaging system 100A includes a plurality of rows 105 for positioning of coiled cables. In the embodiment depicted in FIG. 11, three rows are shown 105A, 105B, 105C, however embodiments of the present inventive concepts are equally applicable to systems with two rows 105 or more than three rows 105 for the positioning of coiled cables.

In the first row 105A, the retainers 102A, 102B defining the row 105A have opposed first retention openings 110A, as described herein. Similarly in the second row 105B, the retainers 102B, 102C defining the row 105B have opposed second retention openings 110B, as described herein. Similarly in the third row 105C, the retainers 102C, 102D defining the row 105C have opposed third retention openings 110C, as described herein. In some embodiments, the first retention openings 110A are dimensioned to retain coiled cables 106A of a first length or coil diameter D, the second retention openings 110B are dimensioned to retain coiled cables 106B of a second length or coil diameter, and the third retention openings 110C are dimensioned to retain coiled cables 106C of a third length or coil diameter. In some embodiments the first length or coil diameter of the first coiled cables 106A can be greater than the second length or coil diameter of the second coiled cables 106B, and the second length or coil diameter of the second coiled cables 106B can be greater than the third length or coil diameter of the third coiled cables 106C. In some embodiments, retention openings 110A that are dimensioned to retain larger coiled cables can have relatively increased width W1 and height H1. In some embodiments, retention openings 110A that are dimensioned to retain relatively larger coiled cables can have relatively increased distance between neighboring retention openings 110A, see for example pitch or distance P of FIG. 3D, in order to accommodate the larger size. In some embodiments, retention openings 110A that are dimensioned to retain smaller coiled cables can have relatively reduced width W1 and height H1. In some embodiments, retention openings 110A that are dimensioned to retain larger coiled cables can have relatively reduced distance between neighboring retention openings 110A, in order to accommodate the relatively smaller size.

The retention strips 102A, 102B, 102C, 102D, can be provided so that their respective retention openings 110A, 110C correspond to the associated row. It can be seen that the first and fourth retention strips 102A, 102D include only a single row of retention openings 110A, 110C, since these strips 102A, 102D are configured for insertion at the front and back sides of the container 104A. In contrast, the second and third retention strips 102B, 102C include opposed first and second rows of retention openings, 110A, 110B and 110B, 110C, for example, in a "back-to-back" configuration.

In some embodiments the retention strips 102A, 102B, 102C, 102D can be configured to be modular in the sense that different retention strips 102 can be swapped and replaced for different rows 105, depending on the desired configuration of the cable packaging system 100A. In some example embodiments, the slits 120 in the various retention strips 102 can be positioned to be the same for all strips 102. Likewise, the vertical members 118 of the supports 114 for all rows 105 of the system 100A can be positioned to correspond with the slits 120. Therefore, the retention strips can be chosen, depending on the desired configuration of the system 100A. For example, the same container 104A and supports can be used for a system where retention of three rows of different-sized coiled cables is desired and for a system where retention of three rows of same-sized coiled cables is desired by simply selecting different retention strips 102 for the system 100A.

In the embodiment of FIG. 11, a system 100A configured for retention and arrangement of coiled cables of different sizes in different rows is illustrated and described. However, embodiments of the present inventive concepts are equally applicable to other arrangements. For example, through proper configuration of the strips 102, different-sized cable coils can be arranged within the same row. For example, two opposed strips 102 of retention openings 110 can have first opposed retention openings of a first geometry (for example, height, width, depth, or spacing) in a first region of the row and second opposed retention openings of a second geometry (for example, height, width, depth, or spacing) in a second region of the row. In this manner, cable coils of different sizes can be accommodated within the same row 105 of the system.

In some embodiments, the distances DR1, DR2, DR3 between the strips 102A, 102B, 102C, 102D can vary in accordance with the type of coiled cable to be associated with the corresponding row 105A, 105B, 105C. For example a larger distance DR1, DR2, DR3 can be provided for a larger type coiled cables of larger coil diameter D. In some embodiments, the distances DR1, DR2, DR3 between the strips 102A, 102B, 102C, 102D can be the same for one or more of the rows 105A, 105B, 105C, irrespective of the associated coiled cable type. In some embodiments the distances DR1, DR2, DR3 can be defined by the distances, in the Z-axis, direction between the vertical members 118.

Figure 12:
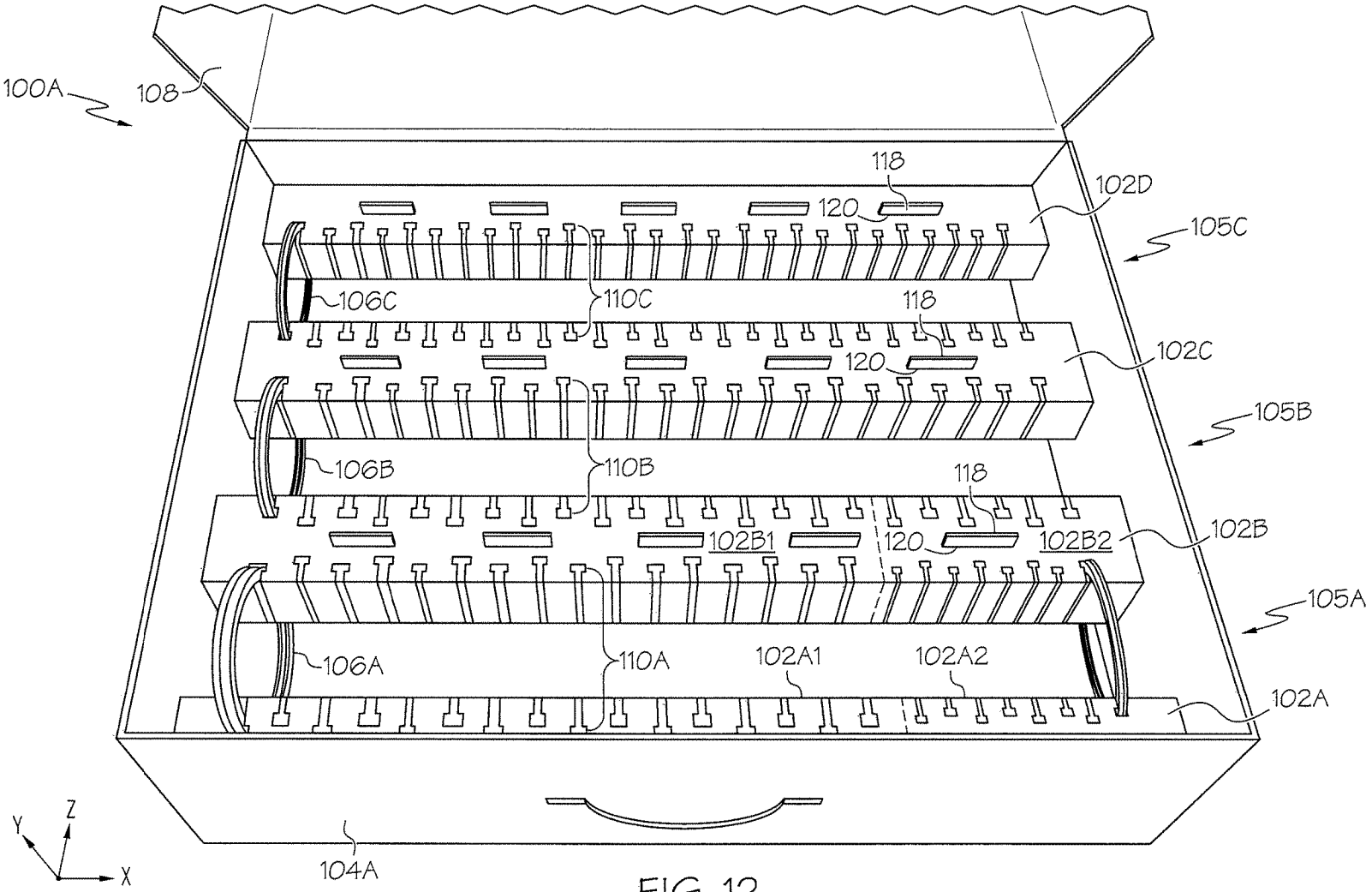
FIG. 12 is a top plan view of an alternative embodiment of a cable packaging system in accordance with principles of inventive concepts, wherein the system is configured to accommodate different-sized coiled cables within a same row of the container.

FIG. 12 is a top plan view of an alternative embodiment of a cable packaging system in accordance with principles of inventive concepts, wherein the system is configured to accommodate different-sized coiled cables within a same row of the container. In particular, it can be seen that the two opposed strips 102A, 102B corresponding to the first row 105A each have a first region 102A1, 102B1 having retention openings configured for a first sized cable coil 106A. The same two opposed strips 102A, 102B corresponding to the first row 105A each further have a second region 102A2, 102B2 having retention openings configured for a second sized cable coil 106D. In this manner, cable coils of different sizes can be accommodated within the same row 105A of the system 100.

FIGS. 13A-13E are conceptual top plan views of a cable packaging system wherein different rows or portions of rows are configured to accommodate different-sized coil cables, in accordance with embodiments of the present inventive concepts.

Figure 13A:
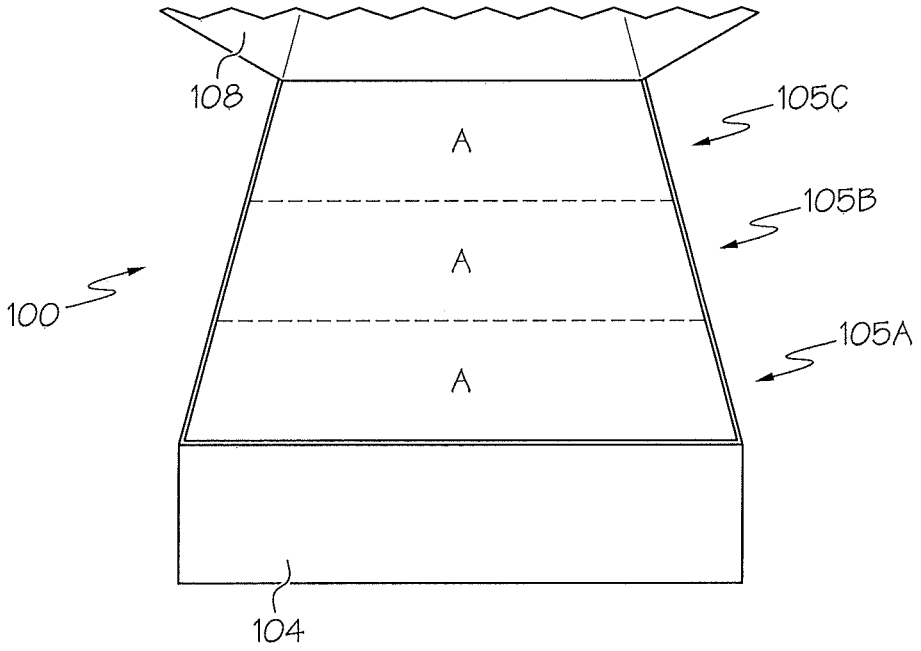
FIGS. 13A-13E are conceptual top plan views of a cable packaging system wherein different rows or portions of rows are configured to accommodate different-sized coil cables, in accordance with embodiments of the present inventive concepts.

In the embodiment of FIG. 13A, all three rows 105A, 105B, 105C of the system 100 are configured to accommodate cable coils of the same type or size A.

Figure 13B:
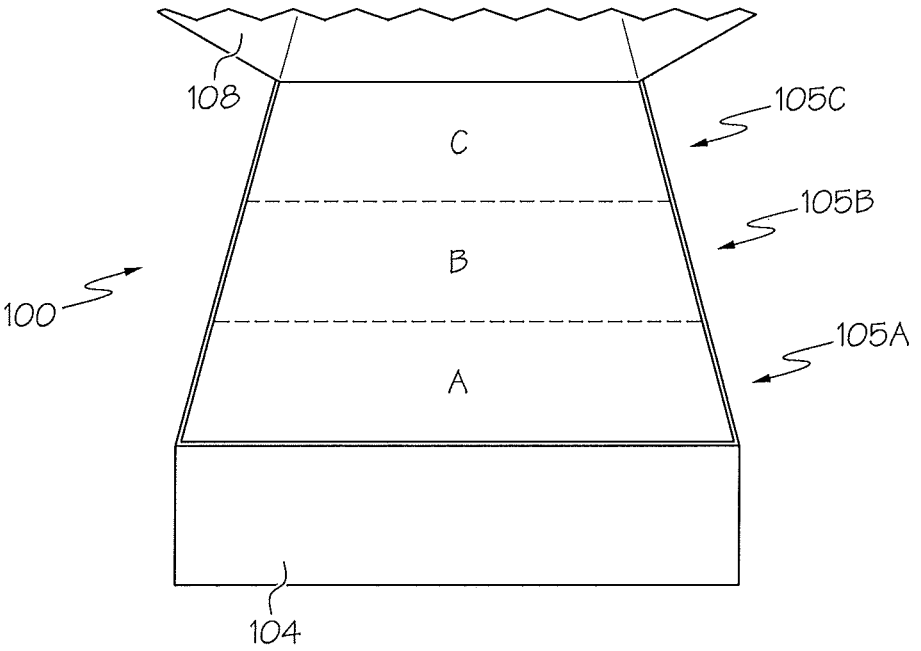

In the embodiment of FIG. 13B, the first row 105A is configured to accommodate cable coils of type A, the second row 105B is configured to accommodate cable coils of type B, and the third row 105C is configured to accommodate cable coils of type C.

Figure 13C:
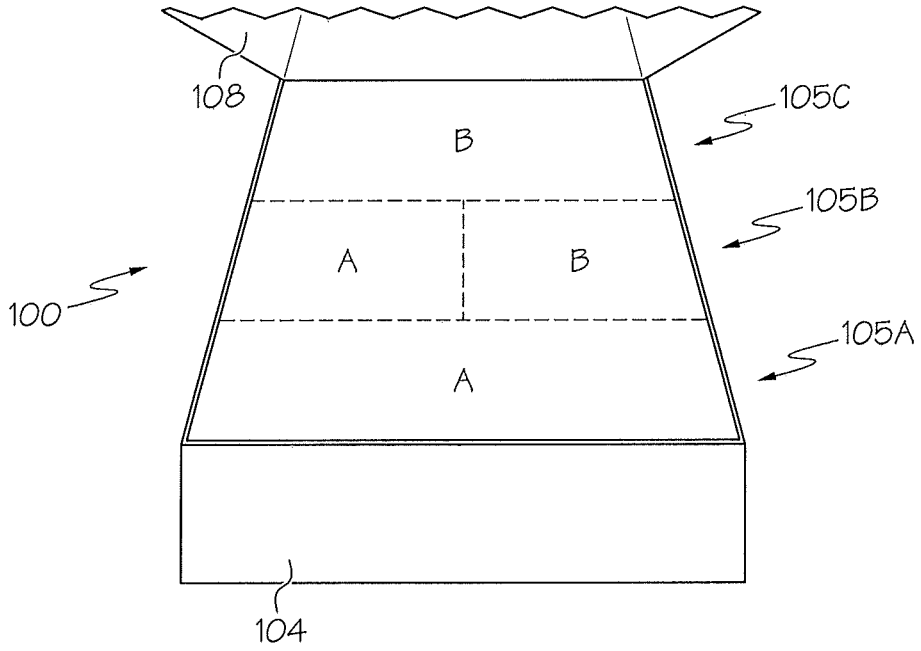

In the embodiment of FIG. 13C, the first row 105A is configured to accommodate cable coils of type A, a first region of the second row 105B is configured to accommodate cable coils of type A and a second region of the second row 105B is configured to accommodate cable coils of type B. The third row 105C is configured to accommodate cable coils of type B.

Figure 13D:
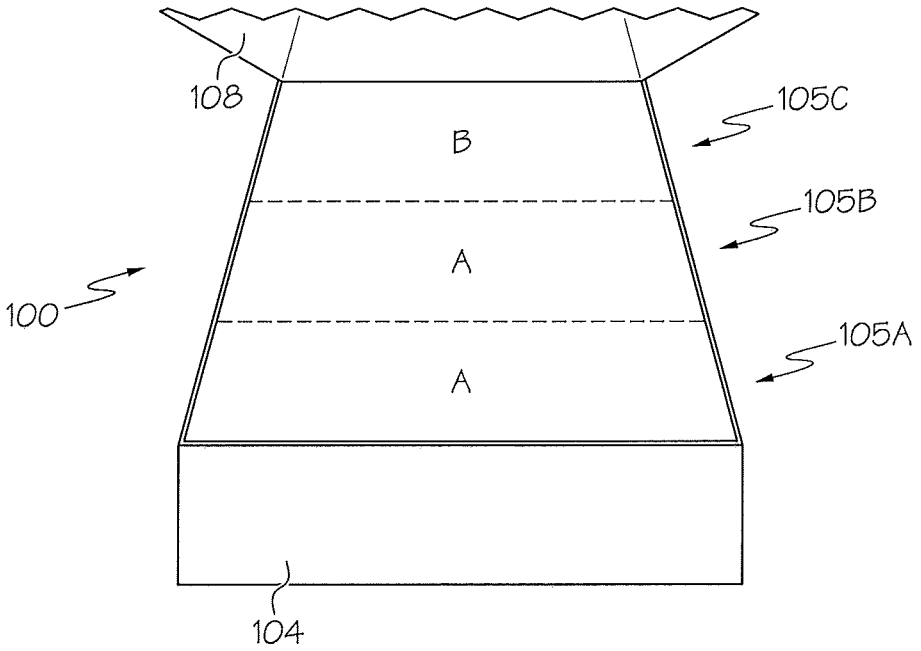

In the embodiment of FIG. 13D, the first row 105A is configured to accommodate cable coils of type A, the second row 105B is configured to accommodate cable coils of type A, and the third row 105C is configured to accommodate cable coils of type B.

Figure 13E:
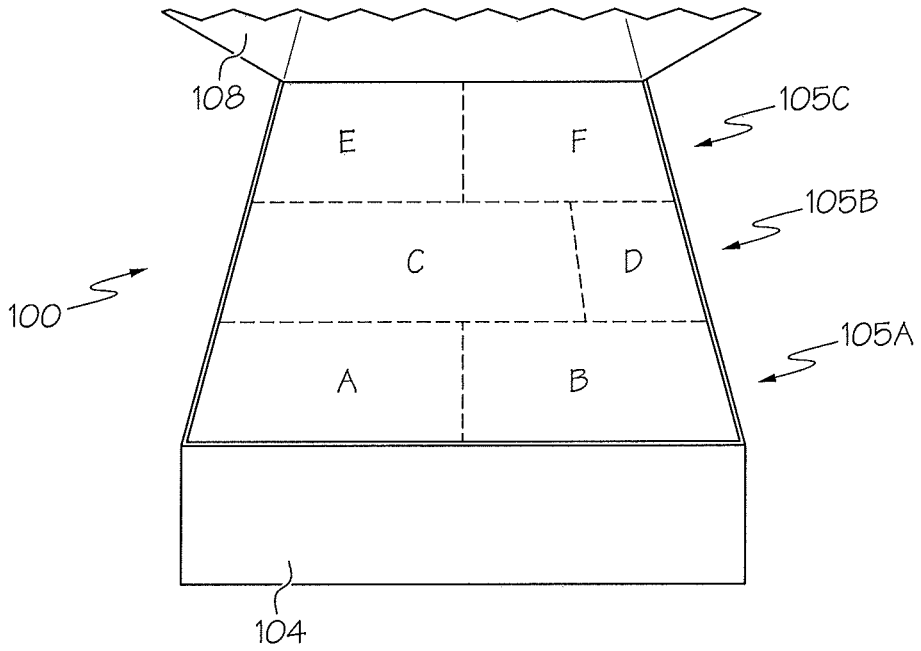

In the embodiment of FIG. 13E, a first region of the first row 105A is configured to accommodate cable coils of type A and a second region of the first row 105A is configured to accommodate cable coils of type B. A first region of the second row 105B is configured to accommodate cable coils of type C and a second region of the second row 105B is configured to accommodate cable coils of type D. The second region of the second row (D) is smaller in area than the second region of the first row (B). A first region of the third row 105C is configured to accommodate cable coils of type E and a second region of the third row 105C is configured to accommodate cable coils of type F.

Figure 14:
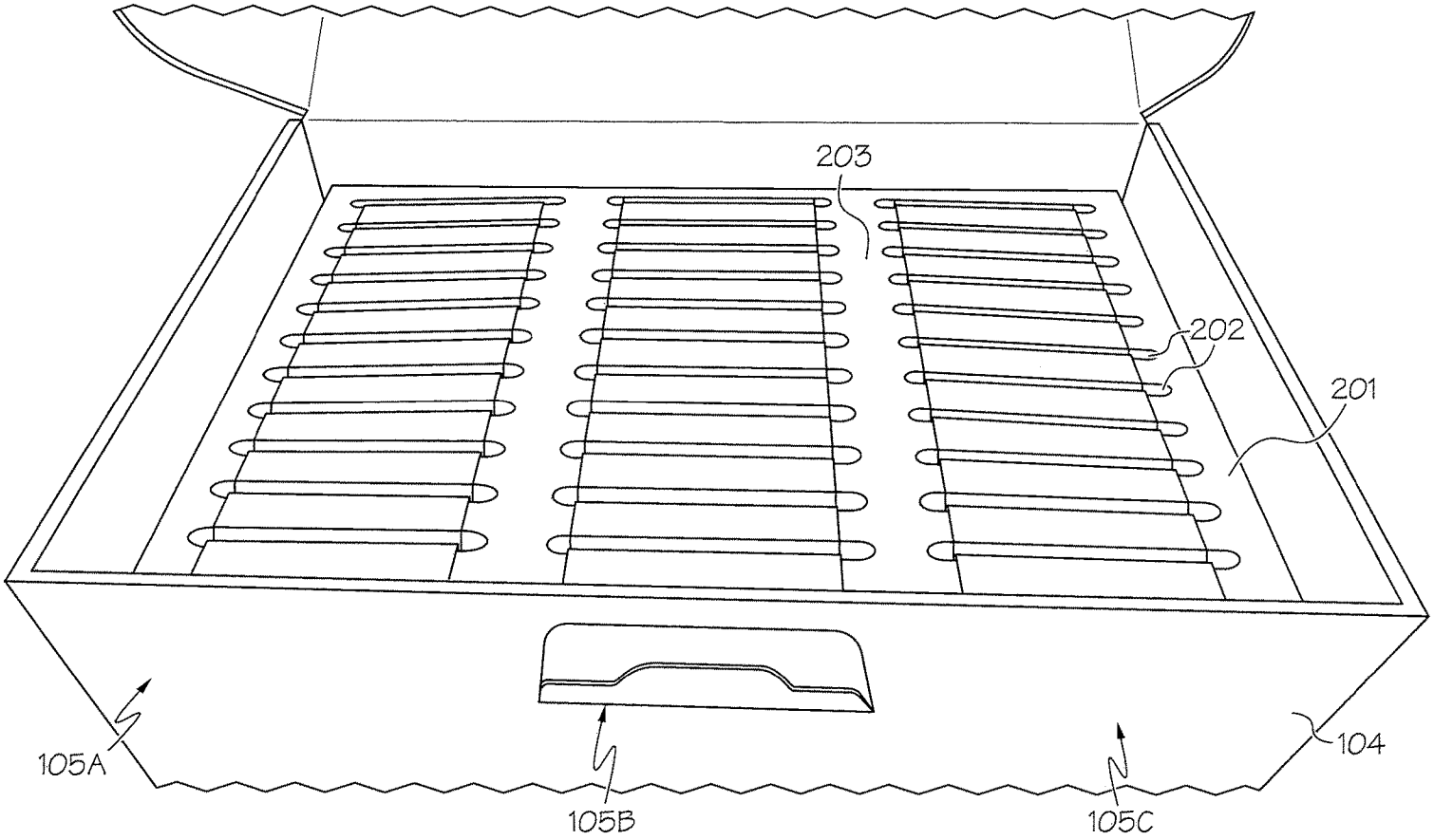
FIGS. 14 and 15 are top plan views of alternative embodiments of a cable packaging system in accordance with principles of inventive concepts.
Figure 15:
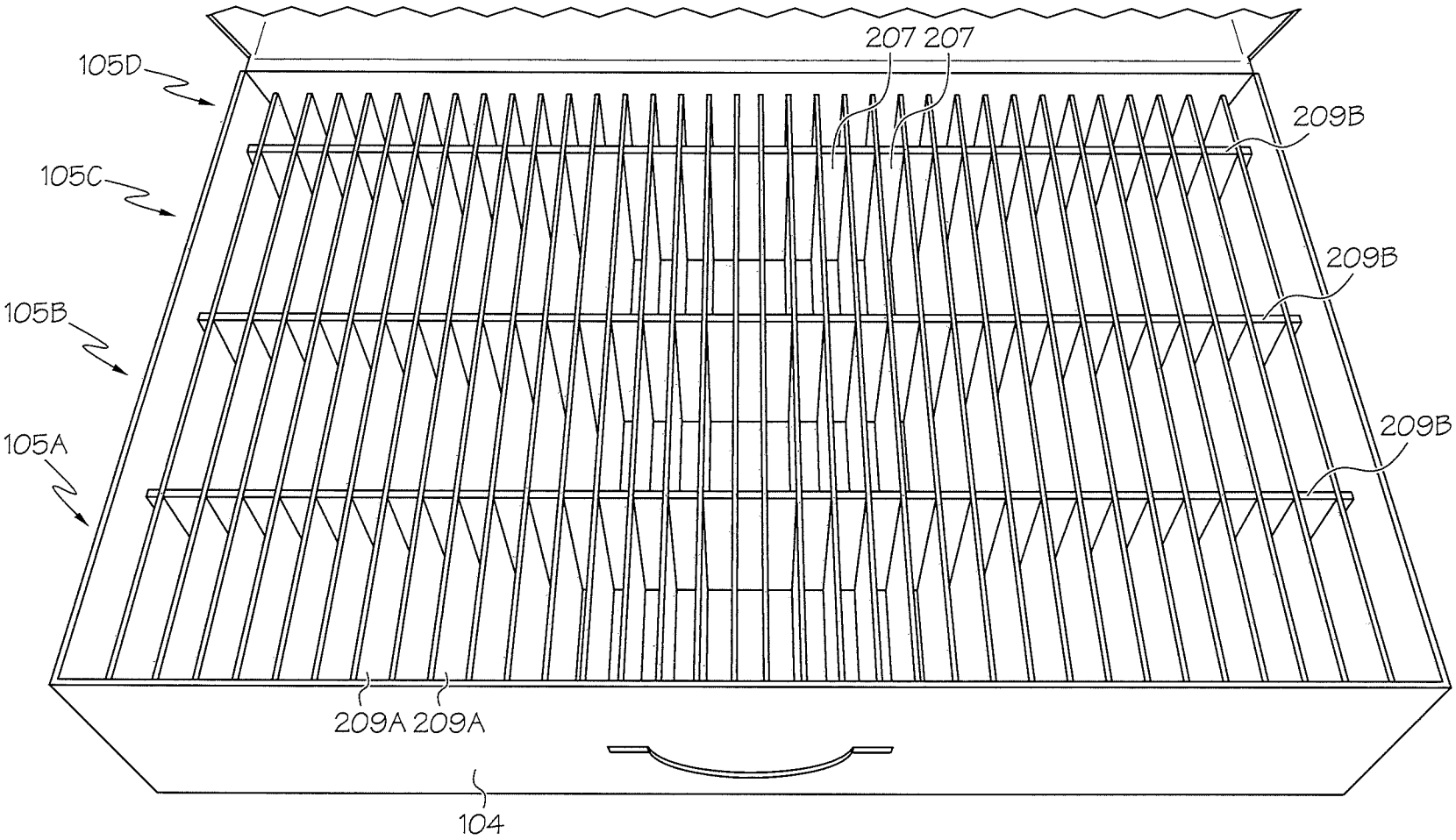

FIGS. 14 and 15 are top plan views of alternative embodiments of a cable packaging system in accordance with principles of inventive concepts.

In the embodiment of FIG. 14, a container 104 includes an insert 201. In various examples, the insert 201 can be formed of paperboard or plastic, or other suitable material. Slots 202 can be formed in an upper surface 203 of the insert 201. The slots 202 can be dimensioned to receive a coiled cable. In some embodiments, the upper surface 203 is spaced apart an appropriate distance from a bottom of the container, so that a lower portion of the coiled cable can lie below the upper surface and so that an upper portion of the coiled cable can lie above the upper surface when the coiled cables are properly inserted in the container. In some embodiments, the coiled cables lie in the slots so that the upper portions are oriented in a vertical direction relative to the container bottom.

In the embodiment of FIG. 15, a container 104 includes an array of cavities 207. The cavities 207 are defined by vertical walls 209A and horizontal walls 209B. In various examples, the vertical walls 209A and horizontal walls 209B can be formed of paperboard or plastic, or other suitable material. The cavities 207 can be dimensioned to receive a coiled cable. In some embodiments, the cavities 207 are dimensioned so that a lower portion of the coiled cable can lie below the walls 209A, 209B and so that an upper portion of the coiled cable can lie above the walls 209A, 209B when the coiled cables are properly inserted in the container. In some embodiments, the coiled cables lie in the cavities so that the upper portions are oriented in a vertical direction relative to the container bottom.

While exemplary embodiments in accordance with principles of inventive concepts have been particularly shown and described with references to exemplary embodiments thereof, it will be understood by those skilled in the art that various changes in form and details may be made herein without departing from the spirit and scope of the inventive concepts as defined herein.

What is claimed is:

1. A packaging system, comprising:

a container to hold coiled cables;

a retainer to hold the coiled cables within the container, the retainer constructed and arranged to hold the coiled cables within the container in a predetermined orientation with respect to a bottom of the container, wherein the retainer comprises a resilient foam retention strip; and a retention element support configured to hold the retainer in a predetermined position relative to the bottom of the container, wherein the retention element support includes a plurality of vertical portions configured to matingly join the resilient foam retention strip of the retainer through support openings in the resilient foam retention strip.

2. The packaging system of claim 1, wherein the resilient foam retention strip of the retainer comprises cable retention openings configured for receiving coiled cables.

3. The packaging system of claim 2, wherein the resilient foam retention strip of the retainer comprises a resilient material and the cable retention openings are configured to deform to receive a coiled cable and return toward a neutral position once the coiled cable is received.

4. The packaging system of claim 3, wherein the resilient foam retention strip of the retainer comprises a resilient foam material.

5. The packaging system of claim 2, wherein the cable retention openings are of a circular cross-section.

6. The packaging system of claim 2, wherein the cable retention openings are of a rectangular cross-section.

7. The packaging system of claim 2, wherein the cable retention openings are staggered in distance from a lateral edge of the retention strip.

8. The packaging system of claim 7, wherein the retainer comprises two retention strips and wherein the two retention strips are arranged with staggered cable retention openings to form alternate-positioned cable receptacles.

9. The packaging system of claim 1, wherein the retainer is configured to hold the coiled cables in a vertical direction relative to the bottom of the container.

10. A packaging system, comprising:

a container including four sidewalls, a bottom and lid;

a retainer, wherein the retainer comprises a plurality of retention strips each having retention openings; and a plurality of retention element supports, supporting the retention strips at a predetermined height above the bottom within the container, wherein the retention strips are composed of a resilient material and wherein a first retention strip and a second retention strip of the plurality of retention strips are in contact with opposing sidewalls of the container.

11. The packaging system of claim 10, wherein the plurality of retention strips are composed of a resilient foam material.

12. The packaging system of claim 10, further comprising a third retention strip positioned between the first and second retention strips, the third retention strip supported by a first one and a second one of the plurality of retention element supports.

13. The packaging system of claim 12, wherein at least two of the plurality of retention strips are paired to support coiled cables and the distance between paired retention strips is predetermined to accommodate a diameter of the coiled cables.

14. A method of packaging cables, comprising:

providing a container including four sidewalls, a bottom and lid;

providing a retainer, wherein the retainer comprises:

a plurality of retention strips each having retention openings; and a plurality of retention element supports supporting the retention strips at a predetermined height above the bottom within the container, wherein the retention strips are composed of a resilient material and a first retention strip and a second retention strip of the plurality of retention strips are in contact with opposing sidewalls of the container; and providing coiled cables, the coiled cables inserted in pairs of retention openings in the retention strips, thereby retaining the coiled cables in an upright position relative to the bottom of the container.

15. The method of packaging cables of claim 14, wherein the plurality of retention strips are composed of a resilient foam material.

16. The method of packaging cables of claim 14, further comprising a third retention strip positioned between the first and second retention strips.

17. The method of packaging cables of claim 16, wherein at least two of the plurality of retention strips are paired to support the coiled cables and wherein the distance between paired retention strips is predetermined to accommodate a diameter of the coiled cables.

18. The method of packaging cables of claim 14, wherein the retention openings are staggered to retain the coiled cables in a staggered arrangement.

19. The packaging system of claim 13 wherein a first distance between the first retention strip and the third retention strip to accommodate a first diameter of first ones of the coiled cables is different than a second distance between the third retention strip and the second retention strip to accommodate a second diameter of second ones of the coiled cables.

20. The packaging system of claim 17 wherein a first distance between the first retention strip and the third retention strip to accommodate a first diameter of first ones of the coiled cables is different than a second distance between the third retention strip and the second retention strip to accommodate a second diameter of second ones of the coiled cables.

* * * * *